US007635098B2

(12) United States Patent
Tojo et al.

(10) Patent No.: US 7,635,098 B2
(45) Date of Patent: Dec. 22, 2009

(54) FUEL INJECTION DEVICE INHIBITING ABRASION

(75) Inventors: Senta Tojo, Nagoya (JP); Takaharu Sako, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/076,592

(22) Filed: Mar. 20, 2008

(65) Prior Publication Data

US 2008/0173734 A1 Jul. 24, 2008

Related U.S. Application Data

(62) Division of application No. 11/038,226, filed on Jan. 21, 2005, now Pat. No. 7,367,517.

(30) Foreign Application Priority Data

Jan. 27, 2004 (JP) ..... 2004-018727

(51) Int. Cl.
*F02M 61/10* (2006.01)

(52) U.S. Cl. ..... 239/533.11; 239/533.3; 239/533.9; 239/533.12; 239/584; 239/DIG. 19

(58) Field of Classification Search ..... 239/88, 239/96, 533.2, 533.3, 533.8, 533.9, 533.11, 239/533.12, 584
See application file for complete search history.

(56) References Cited

U.S. PATENT DOCUMENTS 4,005,826 A * 2/1977 Woodward ..... 239/533.8
4,360,162 A * 11/1982 Eckert ..... 239/533.4
4,583,687 A 4/1986 Gaskell et al.
4,852,808 A * 8/1989 Yamamoto ..... 239/533.3
5,692,683 A * 12/1997 Mathis ..... 239/584
6,283,389 B1 9/2001 Hofmann
6,477,940 B1 11/2002 Danckert (Continued)

FOREIGN PATENT DOCUMENTS

DE 19956830 A1 6/2001

(Continued)

OTHER PUBLICATIONS

French Search Report issued in corresponding French Application No. 0500822.

(Continued)

*Primary Examiner*—Steven J Ganey
(74) *Attorney, Agent, or Firm*—Nixon & Vanderhye, PC

(57) ABSTRACT

A fuel injection device has a nozzle body formed with an injection hole for injecting fuel and a nozzle needle reciprocating in the nozzle body to open and to close the injection hole. The nozzle needle has a sliding portion capable of moving in the nozzle body in a sliding manner, an insertion portion, of which diameter is smaller than that of the sliding portion, and a pressure receiving portion connecting the sliding portion with the insertion portion. The nozzle body has a guide portion for slidably holding the sliding portion and a fuel sump chamber formed on the injection hole side of the guide portion. The insertion portion is inserted through the fuel sump chamber. A clearance decreasing toward the fuel sump chamber is provided between the guide portion and the sliding portion.

5 Claims, 4 Drawing Sheets

U.S. PATENT DOCUMENTS

| | | | |
|---|---|---|---|
| 6,698,666 | B2 | 3/2004 | Ohata et al. |
| 6,918,377 | B2 | 7/2005 | Boltz |
| 7,066,397 | B2 | 6/2006 | Astachow |
| 7,066,410 | B2 | 6/2006 | Ruthardt |
| 7,143,965 | B2 | 12/2006 | Lindner |
| 2004/0124286 | A1 | 7/2004 | Schorr et al. |

FOREIGN PATENT DOCUMENTS

| | | | |
|---|---|---|---|
| DE | 10023957 | A1 | 11/2001 |
| EP | 1156209 | A | 11/2001 |
| EP | 1 666 720 | A1 | 6/2006 |
| GB | 2298897 | A | 9/1996 |
| JP | 11-229998 | A | 8/1999 |
| JP | 11-324864 | A | 11/1999 |
| JP | A-2003-83203 | | 3/2003 |
| JP | 2005-90421 | A | 4/2005 |
| WO | WO 02/064969 | A | 8/2002 |

OTHER PUBLICATIONS

Chinese Examination Report issued Aug. 17, 2007 in Chinese Application No. 200510005869.6 with English translation.
Japanese Office Action mailed Sep. 18, 2007 in Japanese Application No. 2004-018727 with English translation.

* cited by examiner

FUEL INJECTION DEVICE INHIBITING ABRASION

CROSS REFERENCE TO RELATED APPLICATIONS

This application is a division of application Ser. No. 11/038,226, filed Jan. 21, 2005, which is in turn based on Japanese Patent Application No. 2004-18727 filed on Jan. 27, 2004, the disclosures of each of which are incorporated herein by reference.

BACKGROUND OF THE INVENTION

1. Field of the Invention

The present invention relates to a fuel injection device. The present invention can be suitably applied to a fuel injection device mounted to each cylinder of an internal combustion engine for injecting fuel into the cylinder.

2. Description of Related Art

A fuel injection valve of a fuel injection system of a diesel engine is known as a fuel injection device. The fuel injection valve is mounted to each cylinder of the engine and injects fuel into a combustion chamber of the cylinder. The fuel injection valve includes a nozzle body, which is formed with injection holes for injecting the fuel, and a nozzle needle, which ascends and descends inside the nozzle body to open and close the injection holes, as described in Unexamined Japanese Patent Application Publication No. 2003-83203. In this kind of fuel injection valve, the nozzle needle has a sliding portion in the shape of a circular column, which can move in the nozzle body in a sliding manner, an insertion portion in the shape of a circular column, of which external diameter is smaller than that of the sliding portion, and a pressure-receiving portion connecting the sliding portion with the insertion portion. The nozzle body is formed with a guide portion, which holds the sliding portion in a sliding manner, and with a fuel sump chamber, which is formed on an injection hole side of the guide portion. The insertion portion is inserted through the fuel sump chamber.

High-pressure fuel, which is to be injected through the injection holes, is supplied to the fuel sump chamber. The high-pressure fuel leaks through a clearance between the sliding portion and the guide portion.

A fuel injection valve of a common rail type fuel injection system as a fuel injection system of a diesel engine disclosed in Unexamined Japanese Patent Application Publication No. 2003-166457 includes a nozzle needle, a nozzle body, a body for holding the nozzle body, and a command piston. The command piston reciprocates inside the body to directly or indirectly move the nozzle needle. A control chamber is formed on a side of the command piston opposite from the nozzle needle. The fuel pressure in the control chamber can be changed by opening or closing an electromagnetic valve. When the electromagnetic valve is closed, the high-pressure fuel is supplied into the control chamber, and the control chamber is filled with the high-pressure fuel. A sliding portion of the command piston and a guide portion of the body can slide on each other. When the control chamber is filled with the high-pressure fuel, the high-pressure fuel leaks through the clearance between the sliding portion of the command piston and the guide portion of the body.

The sliding portion of the nozzle needle, the guide portion of the nozzle body and the fuel sump chamber constitute an in-high-pressure-oil sliding part for storing high-pressure hydraulic oil inside. The sliding portion of the command piston, the guide portion of the body and the control chamber constitute another in-high-pressure-oil sliding part for storing the high-pressure hydraulic oil inside.

As shown in FIG. 6, in the in-high-pressure-oil sliding part, an inner periphery of the guide portion 12 on the fuel sump chamber 16 side is enlarged by deformation due to the high-pressure fuel stored in the fuel sump chamber 16. Accordingly, a clearance 451 between the inner periphery of the guide portion 12 and the sliding portion 32 of the nozzle needle on the fuel sump chamber 16 side is enlarged. Therefore, the fuel leak quantity increases as the fuel pressure increases.

In the above structure of the related art having the in-high-pressure-oil sliding part shown in FIG. 6, there is a possibility that the sliding portion 32 of the nozzle needle on a low-pressure side contacts the guide portion 12 of the nozzle body, and a pressure between the contacting surfaces of the sliding portion 32 and the guide portion 12 increases if the guide portion 12 is deformed by the high-pressure fuel. Therefore, there is a possibility that at least one of the sliding portion 32 of the nozzle needle on the low-pressure side (in an area A in FIG. 6) and the guide portion 12 of the nozzle body facing the sliding portion 32 on the low-pressure side (in the area A in FIG. 6) is abraded.

As a result, the clearance between the sliding portion 32 and the guide portion 12 will enlarge and the fuel leak quantity will increase.

In the technology of the related art having the command piston, the long command piston is reciprocated by changing the pressure in the control chamber, of which pressure is changed by opening or closing the electromagnetic valve. Therefore, there is a possibility that the clearance between the command piston and the body enlarges and the fuel leak quantity further increases.

SUMMARY OF THE INVENTION

It is therefore an object of the present invention to provide a fuel injection device capable of inhibiting abrasion of a sliding portion of a nozzle needle and a guide portion of a nozzle body, which can slide on each other, or abrasion of a sliding portion of a command piston and a guide portion of a body, which can slide on each other. Thus, an increase in a quantity of leak fuel with time can be inhibited.

According to an aspect of the present invention, a fuel injection device has a nozzle body and a nozzle needle. The nozzle body is formed with injection hole for injecting fuel. The nozzle needle reciprocates in the nozzle body to open and to close the injection hole. The nozzle needle includes a sliding portion capable of moving in the nozzle body in a sliding manner, an insertion portion, of which diameter is smaller than that of the sliding portion, and a pressure receiving portion connecting the sliding portion with the insertion portion. The nozzle body includes a guide portion for slidably holding the sliding portion and a fuel sump chamber formed on the injection hole side of the guide portion so that the insertion portion is inserted through the fuel sump chamber. The guide portion and the sliding portion provide a clearance therebetween so that the clearance decreases toward the fuel sump chamber.

The clearance provided between the sliding portion of the nozzle needle and the guide portion of the nozzle body, which can slide on each other, when the nozzle needle and the nozzle body are assembled into a single piece of the fuel injection device decreases toward the fuel sump chamber, into which the high-pressure fuel is supplied. Thus, if the high-pressure fuel is introduced into the fuel sump chamber when the fuel injection device is actually in the injecting state, an inner periphery of the guide portion on the fuel sump chamber side is enlarged by deformation due to the high-pressure fuel. Thus, the clearance on the fuel sump chamber side is enlarged. Therefore, the clearance on the fuel sump chamber side and the clearance on the side opposite from the fuel sump chamber can be set to substantially coincide with each other in accordance with a pressure of the high-pressure fuel in a used range. The clearance between the sliding portion and the guide portion becomes substantially even when the pressure of the high-pressure fuel is at a predetermined high pressure. Accordingly, the sliding portion and the guide portion contact each other in a large area. As a result, a pressure acting on contacting surfaces can be reduced and abrasion can be inhibited. Thus, an increase in a fuel leak quantity with time can be inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS

First Embodiment

Figure 1:
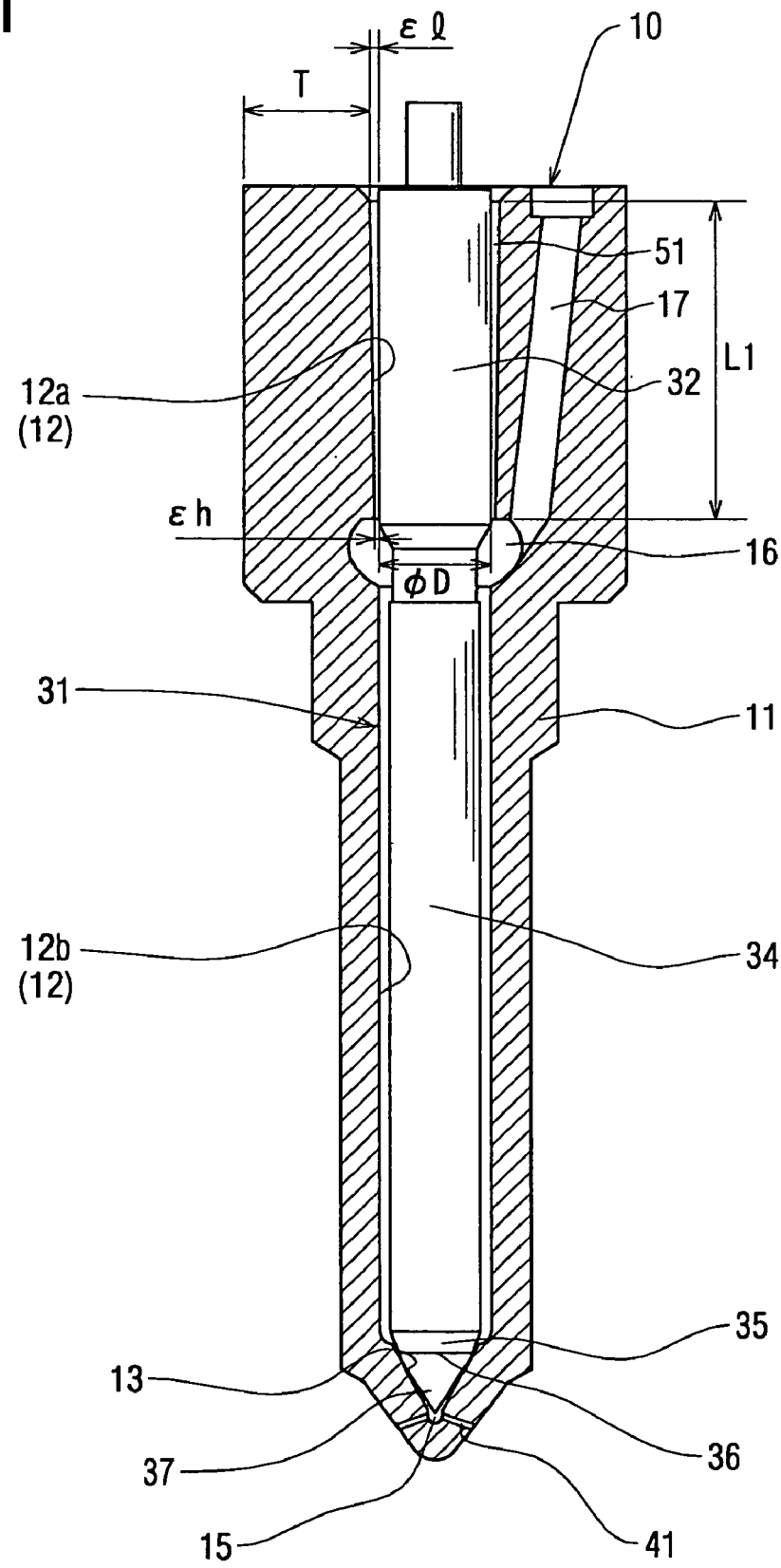
FIG. 1 is a sectional view showing a fuel injection device according to a first embodiment of the present invention.

Referring to FIG. 1, a fuel injection device 10 according to a first embodiment of the present invention is illustrated.

As shown in FIG. 1, a fuel injection device 10 includes a nozzle body 11 and a nozzle needle 31. The needle 31 is mounted in the nozzle body 11 so that the needle 31 can reciprocate along an axial direction.

As shown in FIG. 1, the nozzle body 11 is a substantially cylindrical hollow member having a bottom. A guide hole 12, a valve seat 13, multiple injection holes 41 and a sack portion 15 are formed in the nozzle body 11. The guide hole 12 extends along the axial direction of the nozzle body 11 inside the nozzle body 11. An end of the guide hole 12 extends to an end opening of the nozzle body 11 (an upper end in FIG. 1) and the other end of the guide hole 12 extends to the valve seat 13. An internal diameter of an inner surface of the guide hole 12 is substantially constant in a range from the end opening of the nozzle body 11 to the proximity of the valve seat 13.

As shown in FIG. 1, the valve seat 13 has a surface in the shape of an inverse truncated cone. An end of the valve seat 13 on a large diameter side is contiguous to the guide hole 12 and the other end of the valve seat 13 on a small diameter side is contiguous to the sack portion 15. A contacting portion 36 of the needle 31 can contact and recede from the valve seat 13. Conceptually, the contacting portion 36 is formed in a circular shape. The sack portion 15 is a sack hole in the shape of a sack, which is formed in a front portion of the nozzle body 11 and provides a small space of a certain small volume. An opening side of the sack hole is contiguous to the small diameter side of the valve seat 13. The sack portion 15 provides a sack chamber in the shape of a sack having a predetermined volume.

As shown in FIG. 1, the injection hole 41 is formed in the sack portion 15 of the nozzle body 11 as a passage for connecting an inside and an outside of the nozzle body 11 with each other.

As shown in FIG. 1, an oil sump chamber (a fuel sump chamber) 16 is an annular cavity provided at a middle portion of an inner wall surface providing the guide hole 12 of the nozzle body 11. The high-pressure fuel sump chamber 16 is connected with a fuel supply hole 17, into which the fuel is supplied from the outside. The fuel sump chamber 16 divides the guide hole 12 into a guide hole upper portion 12*a* and a guide hole lower portion 12*b*.

Basically, the needle 31 is formed in the shape of a solid circular column. As shown in FIG. 1, the needle 31 includes a large diameter circular column portion 32, a small diameter circular column portion 34, a truncated cone portion 35 and a conical portion 37.

An external diameter of the large diameter circular column portion 32 is substantially constant. The large diameter circular column portion 32 is loosely inserted into the guide hole 12 (more specifically, the guide hole upper portion 12*a*) with a predetermined clearance. Therefore, the large diameter circular column portion 32 can reciprocate in the axial direction. The small diameter circular column portion 34 extends from the proximity of the high-pressure fuel sump chamber 16 to the proximity of the valve seat 13 along the axial direction. An external diameter of the small diameter circular column portion 34 is set smaller than that of the large diameter circular column portion 32. The clearance between the small diameter circular column portion 34 and the inner wall surface of the guide hole 12 provides a fuel passage.

One end of the truncated cone portion 35 is contiguous to the small diameter circular column portion 34, and the other end of the truncated cone portion 35 is connected to the conical portion 37 through the circular contacting portion 36. The connection between the truncated cone portion 35 and the conical portion 37 provides a circular portion, which serves as the contacting portion when the valve (the needle 31) is closed. Inclination of the conical portion 37 is greater than that of the valve seat 13. Thus, contact and fluid tightness between the contacting portion 36 and the valve seat 13 can be ensured when the valve is closed. The tip end of the conical portion 37 is positioned to face the sack portion 15 when the valve is closed.

The large diameter circular column portion 32 provides a sliding portion capable of sliding in the nozzle body 11. The small diameter circular column portion 34, the truncated cone portion 35 and the conical portion 37 provide an insertion portion, whose diameter is smaller than that of the sliding portion. A portion substantially in the shape of a truncated cone provided at a connection between the large diameter circular column portion 32 and the small diameter circular column portion 34 provides a pressure-receiving portion. The pressure-receiving portion is pushed by the high-pressure fuel introduced into the high-pressure fuel sump chamber 16 in a direction for separating the contacting portion 36 from the valve seat 13, or a direction for opening the needle 31. The insertion portion 34, 35, 37 is inserted through the high-pressure fuel sump chamber 16.

The guide hole upper portion 12*a* (more specifically, the guide hole upper portion 12*a* and the wall portion defining the guide hole upper portion 12*a*) provides a guide portion for slidably holding the sliding portion 32.

In the present embodiment, the predetermined clearance 51 provided between the sliding portion 32 and the guide portion 12*a* is reduced toward the fuel sump chamber 16 as shown in FIG. 1. More specifically, the diameter of the guide portion, or the diameter of the guide hole upper portion 12*a*, decreases toward the fuel sump chamber 16. In an assembled state of the needle 31 and the nozzle body 11 shown in FIG. 1, the clearance 51 is set so that a part of the clearance 51 on the fuel sump chamber side 16 (referred to as a fuel sump chamber side clearance $\epsilon h$, hereafter) is smaller than another part of the clearance 51 on a side opposite from the fuel sump chamber 16 side (referred to as an opposite end side clearance $\epsilon l$, hereafter).

The clearance 51 is set so that the fuel sump chamber side clearance $\epsilon h$ substantially coincides with the opposite end side clearance $\epsilon l$ in a predetermined pressure range of the high-pressure fuel used by the fuel injection device 10.

Next, operation of the fuel injection device 10 having the above structure will be explained. The high-pressure fuel pressure-fed by a fuel pump is stored in the high-pressure fuel sump chamber 16. If the fuel pressure in the fuel sump chamber 16 exceeds a predetermined valve opening pressure, the needle 31 is pushed upward in FIG. 1, and the contacting portion 36 of the needle 31 is separated from the valve seat 13. Thus, the high-pressure fuel flows into the sack portion (the sack chamber) 15 through the fuel passage provided by the clearance between the small diameter circular column portion 34 and the guide hole 12 and the clearance provided when the contacting portion 36 is separated from the valve seat 13. The clearance between the contacting portion 36 and the valve seat 13 corresponds to a lifting distance of the needle 31. The high-pressure fuel is injected into a combustion chamber of the engine through the multiple (four, in the present embodiment) injection holes 41 opening into the sack chamber 15. The valve opening pressure is mainly defined by the biasing force of biasing means such as a spring for biasing the needle 31 in the valve closing direction.

Figure 2:
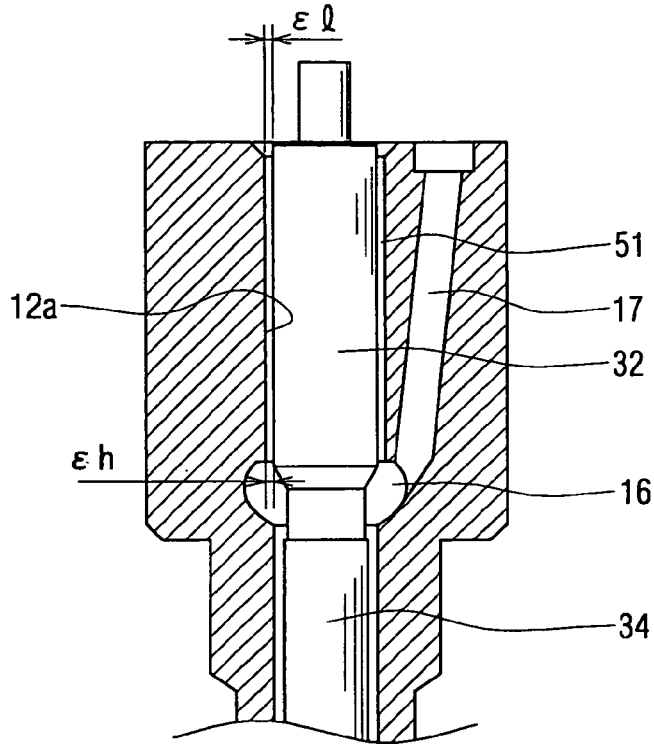
FIG. 2 is a partial sectional view showing a neighborhood of a sliding portion and a guide portion of the fuel injection device according to the first embodiment.

If the high-pressure fuel is introduced into the high-pressure fuel sump chamber 16 and stored there, the fuel leaks through the clearance 51 from the fuel sump chamber side clearance $\epsilon h$ toward the opposite end side clearance $\epsilon l$. The pressure of the high-pressure fuel stored in the high-pressure fuel sump chamber 16 directly acts on the inner periphery of the guide hole upper portion 12*a* on the fuel sump chamber 16 side. Therefore, the inner periphery of the guide hole upper portion 12*a* on the fuel sump chamber 16 side is deformed by the pressure, and the clearance $\epsilon h$ enlarges. The leak fuel is discharged to the outside from the opposite end side clearance $\epsilon l$, and the pressure of the leak fuel is reduced at the clearance $\epsilon l$. Accordingly, the deformation of the clearance $\epsilon l$ is small and enlargement of the clearance $\epsilon l$ is small. Thus, the fuel sump chamber side clearance $\epsilon h$ substantially coincides with the opposite end side clearance $\epsilon l$ in the predetermined pressure range. As a result, the clearance 51 becomes substantially even as shown in FIG. 2. Accordingly, the large diameter circular column portion 32 contacts the guide hole upper portion 12*a* in a large area. As a result, the pressure acting on the contacting surfaces can be reduced and the abrasion can be inhibited.

In the assembled state in which the needle 31 and the nozzle body 11 are assembled into the single piece of the fuel injection device 10, the clearance 51 provided between the large diameter circular column portion (the sliding portion) 32 and the guide hole upper portion (the guide portion) 12*a*, which can slide on each other, decreases toward the fuel sump chamber 16 ($\epsilon h<\epsilon l$). Thus, if the high-pressure fuel is introduced into the fuel sump chamber 16 when the fuel injection device 10 is actually in an injecting state as shown in FIG. 2, the inner periphery of the guide hole upper portion 12*a* on the fuel sump chamber 16 side is enlarged by the deformation due to the high-pressure fuel. Thus, the fuel sump chamber side clearance $\epsilon h$ is enlarged. Therefore, the clearances $\epsilon h$ and the clearance $\epsilon l$ can be set so that the clearance $\epsilon h$ substantially coincides with the clearance $\epsilon l$ in accordance with the pressure of the high-pressure fuel in the used range. As a result, the clearance 51 becomes substantially even in a state in which the pressure of the high-pressure fuel is at a predetermined pressure or in a predetermined pressure range. Accordingly, the large diameter circular column portion 32 and the guide hole upper portion 12*a*, or the sliding portion and the guide portion, contact each other in a large area. Therefore, the pressure acting on the contacting surfaces can be reduced, and the abrasion can be inhibited. Thus, the increase in the fuel leak with time can be prevented.

The clearance 51 can be reduced toward the fuel sump chamber 16 in the assembled state by reducing the diameter of the guide hole upper portion 12*a*, or the inner periphery of the guide hole 12, toward the fuel sump chamber 16.

The present embodiment can be suitably applied to the fuel injection device 10 structured so that a ratio of the minimum thickness T of the nozzle body at the guide hole upper portion 12*a* to the external diameter $\Phi D$ of the large diameter circular column portion 32 is equal to or greater than 1.0. Even if the ratio $T/\Phi D$ is close to 1.0 as the lower limit, the abrasion between the sliding portion 32 and the guide portion 12*a* can be inhibited and the increase in the leak fuel with time can be prevented. The ratio $T/\Phi D$ should be preferably set at 1.5 or over. As the ratio $T/\Phi D$ is increased, the deformation of the nozzle body (the increase of the clearance 51) under the high pressure can be reduced and the fuel leak can be reduced.

The present embodiment can be suitably applied to the fuel injection device 10 structured so that a ratio of the length L1 of the guide hole upper portion 12*a*, which slidably holds the large diameter circular column portion 32, to the external diameter $\Phi D$ of the large diameter circular column portion 32 is equal to or greater than 2.5. Even if the ratio $L1/\Phi D$ is close to 2.5 as the lower limit, the abrasion between the sliding portion 32 and the guide portion 12*a* can be inhibited and the increase in the fuel leak with time can be prevented. The ratio $L1/\Phi D$ should be preferably set to 5.0 or over.

Second Embodiment

Next, a fuel injection device 10 according to a second embodiment of the present invention will be explained based on FIG. 3.

Figure 3:
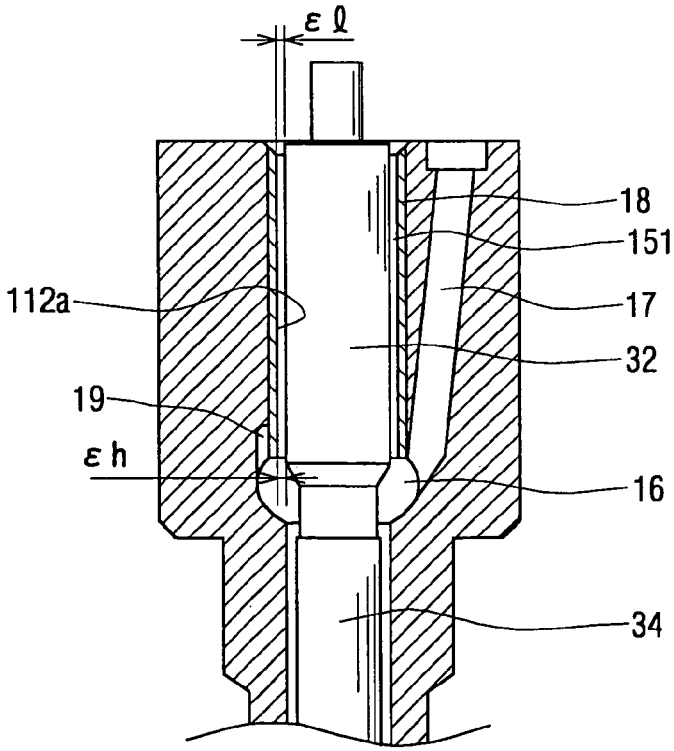
FIG. 3 is a partial sectional view showing a neighborhood of a sliding portion and a guide portion of a fuel injection device according to a second embodiment of the present invention.

In the second embodiment, as shown in FIG. 3, a second fuel sump chamber 19 is formed so that the second fuel sump chamber 19 extends from the fuel sump chamber 16 to the inside of the guide portion 12*a* (or the guide hole upper portion 12*a* and the wall portion providing the guide hole upper portion 12*a*) along the axial direction.

As shown in FIG. 3, a sleeve 18 is fixed in an inner periphery of a guide portion 112*a*. A clearance 151 is provided between the outer periphery of the large diameter circular column portion 32 and an inner periphery of the sleeve 18. The sleeve 18 is inserted and fixed into the guide hole upper portion 12*a* by a press-fitting process and the like. The inner periphery of the sleeve 18 provides the inner periphery of the guide portion 112*a*.

The clearance 151 is formed to be substantially even (the clearance ϵh substantially coincides with the clearance ϵl) in the assembled state.

The second fuel sump chamber 19 provides a substantially annular space in the shape of a half ring and the like radially outside the large diameter circular column portion 32. The second fuel sump chamber 19 may provide an annular space intersecting with the fuel supply hole 17.

Next, effects of the present embodiment will be explained. The fuel sump chamber side clearance ϵh and the second fuel sump chamber 19 communicating with the fuel sump chamber 16 are provided on the inner periphery and the outer periphery of the sleeve 18 respectively so that the sleeve 18 is sandwiched between the fuel sump chamber side clearance eh and the second fuel sump chamber 19. The pressure of the high-pressure fuel acts on both the inner periphery and the outer periphery of the sleeve 18. Therefore, the fuel sump chamber side clearance ϵh is not changed even if the high-pressure fuel is introduced into the fuel sump chamber 16. Therefore, the clearance 151 can be held substantially even when the fuel injection device 10 is in the assembled state or in the injecting state. Accordingly, the large diameter circular column portion 32 and the guide hole upper portion 12*a*, or the sliding portion 32 and the guide portion 112*a*, contact each other in the large area. As a result, the pressure acting on the contacting surfaces can be reduced, and the abrasion can be inhibited.

The sleeve 18 is inserted and fixed into the guide hole upper portion 12*a* by the press-fitting process and the like. Therefore, the manufacturing of the sleeve 18 and the second fuel sump chamber 19 can be performed separately. Thus, the manufacturing of the second fuel sump chamber 19 is facilitated.

Third Embodiment

Figure 4:
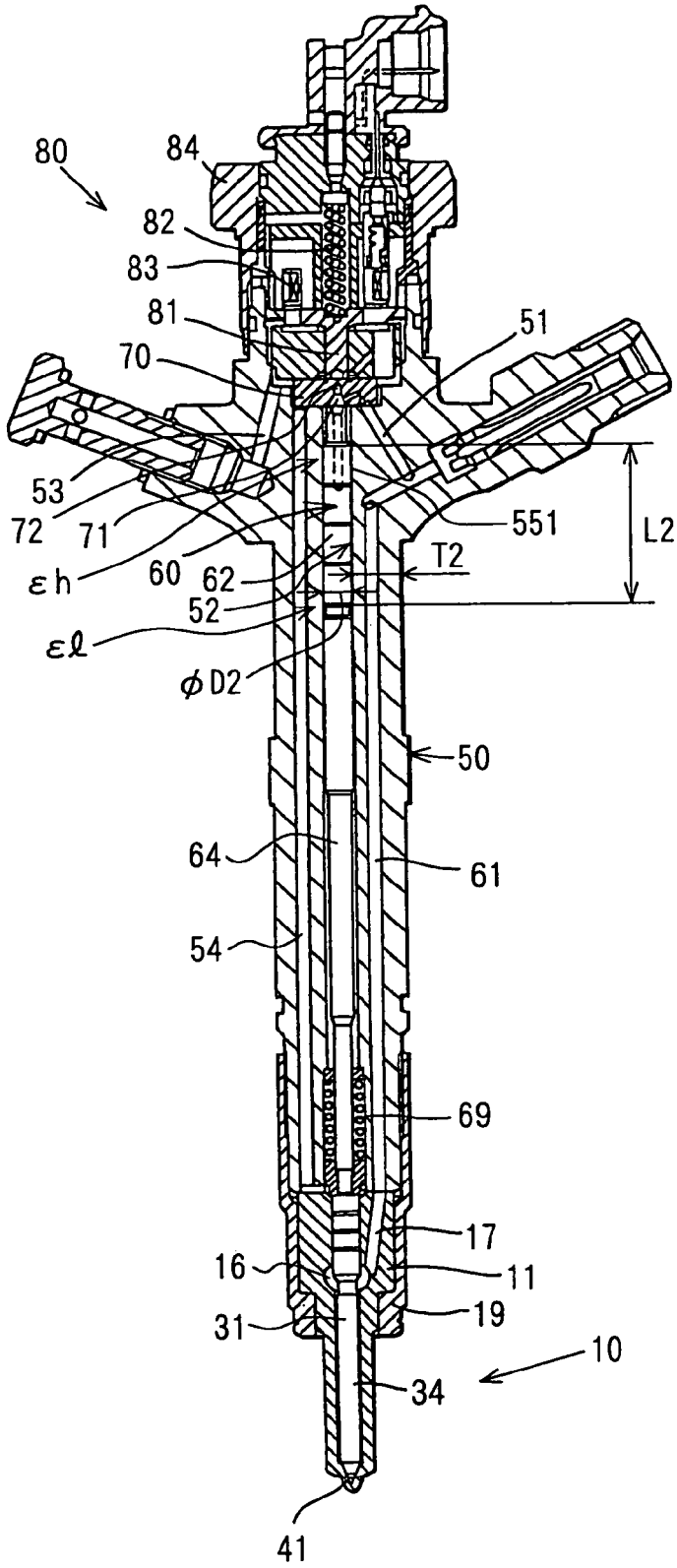
FIG. 4 is a sectional view showing a fuel injection device according to a third embodiment of the present invention.

Next, a fuel injection device 10 according to a third embodiment of the present invention will be explained based on FIG. 4. The fuel injection device 10 of the third embodiment shown in FIG. 4 includes the needle 31 and the nozzle body 11 of the first embodiment and is used in a common rail type fuel injection system as a fuel injection system for a diesel engine. As shown in FIG. 4, the fuel injection device 10 of the third embodiment includes the needle 31, the nozzle body 11, a body (a nozzle holder) 50, a command piston 60, a control chamber (a pressure control chamber) 71, and an electromagnetic valve 80. The needle 31 and the nozzle body 11 constitute a nozzle section. The fuel injection device 10 shown in FIG. 4 injects the high-pressure fuel, which is supplied from the common rail, into the combustion chamber of the engine.

The nozzle section is connected to a lower portion of the nozzle holder 50 by a retaining nut 19. The nozzle holder 50 is formed with a cylinder 52, into which the command piston 60 is inserted, the fuel passage 61 for leading the high-pressure fuel supplied from the common rail toward the nozzle section side, a fuel passage 51 for leading the fuel supplied from the common rail to an orifice plate 70 side, and a discharge passage 53 for discharging the high-pressure fuel to the low-pressure side.

The command piston 60 is slidably inserted through the cylinder 52 of the nozzle holder 50. The command piston 60 is linked with the needle 31 through a pressure pin inserted into the cylinder 52. The pressure pin is interposed between the command piston 60 and the needle 31. The pressure pin is biased by a spring 69 disposed around the pressure pin. Thus, the pressure pin pushes the needle 31 in a valve closing direction (downward in FIG. 4).

The orifice plate 70 is disposed on an end surface of the nozzle holder 50, in which an upper end of the cylinder 52 opens. The orifice plate 70 is formed with a pressure control chamber 71 communicating with the cylinder 52. The orifice plate 70 is formed with an inlet side orifice on an upstream side of the pressure control chamber 71 and an outlet side orifice 72 on a downstream side of the pressure control chamber 71. A flow passage diameter (an internal diameter) of the outlet side orifice 72 is set greater than that of the inlet side orifice.

The inlet side orifice is formed in the orifice plate 70 between the pressure control chamber 71 and the fuel passage 51. An outlet of the inlet side orifice opens in a side surface (a tapered surface) of the pressure control chamber 71. The outlet side orifice 72 is formed above the pressure control chamber 71 in FIG. 4 so that the outlet side orifice 72 can communicate with the discharge passage 53 through the electromagnetic valve 80.

The electromagnetic valve 80 includes an armature 81, a spring 82, a solenoid 83 and the like. The armature 81 provides connection and disconnection between the outlet side orifice 72 and the discharge passage 53. The spring 82 biases the armature 81 in the valve closing direction (downward in FIG. 4). The solenoid 83 drives the armature 81 in the valve opening direction. The electromagnetic valve 80 is mounted to the upper portion of the nozzle holder 50 through the orifice plate 70 and is fixed by a retaining nut 84. If the solenoid 83 is energized, the armature 81 is attracted upward against the biasing force of the spring 82 and opens the outlet side orifice 72. If the energization of the solenoid 83 is stopped, the armature 81 is pushed back by the biasing force of the spring 82 and closes the outlet side orifice 72.

In the present embodiment, the command piston 60 includes a second sliding portion 62, which can slide inside the cylinder 52 as a second guide portion, and a second insertion portion 64, of which diameter is smaller than that of the second sliding portion 62. The nozzle holder 50 is formed with the cylinder 52 and the pressure control chamber 71 formed on the end side of the command piston 60 opposite from the needle 31. A space between the cylinder 52 and the second insertion portion 64 communicates with a discharge passage 54 communicating with the discharge passage 53 and provides a back pressure space of the needle 31. The space between the cylinder 52 and the second insertion portion 64 communicates with the return fuel, or the fuel on the fuel tank side.

A clearance 551 provided between the cylinder 52 and the second sliding portion 62 decreases toward the pressure control chamber 71. More specifically, the diameter of the inner periphery of the cylinder 52 decreases toward the pressure control chamber 71. In an assembled state of the nozzle holder 50 and the command piston 60 shown in FIG. 4, a part of the clearance 551 on the pressure control chamber 71 side (a clearance ϵh) is smaller than another part of the clearance 551 on a side opposite from the pressure control chamber 71 (a clearance ϵl).

The clearance ϵh is set to substantially coincide with the clearance ϵl in a predetermined pressure range of the high-pressure fuel supplied from the common rail, which is used by the fuel injection device 10.

Next, operation of the fuel injection device 10 having the above structure will be explained. The high-pressure fuel supplied from the common rail to the fuel injection device 10 is introduced into a high-pressure fuel passage, which introduces the high-pressure fuel into the fuel supply hole 17 through the fuel passage 61, and into another high-pressure fuel passage, which introduces the high-pressure fuel into the pressure control chamber 71 through the fuel passage 51. At that time, if the electromagnetic valve 80 is in a closed state (a state in which the armature 81 closes the outlet side orifice 72), the pressure of the high-pressure fuel introduced into the pressure control chamber 71 acts on the needle 31 through the command piston 60 and biases the needle 31 in the valve closing direction with the spring 69. The high-pressure fuel introduced into the fuel supply hole 17 is introduced into the fuel sump chamber 16, and the pressure of the fuel acts on the pressure receiving surface of the needle 31 to bias the needle 31 in the valve opening direction. In the state in which the electromagnetic valve 80 is closed, the force biasing the needle 31 in the valve closing direction is greater than the force biasing the needle 31 in the valve opening direction. Therefore, the needle 31 does not lift. Accordingly, the needle 31 keeps closing the injection holes 41, and the fuel is not injected.

If the solenoid 83 of the electromagnetic valve 80 is energized and the electromagnetic valve 80 opens (the armature 81 opens the outlet side orifice 72), the outlet side orifice 72 communicates with the discharge passage 53 formed in the nozzle holder 50. Accordingly, the fuel in the pressure control chamber 71 is discharged from the discharge passage 53 through the outlet side orifice 72. Even if the electromagnetic valve 80 opens, the high-pressure fuel is continuously supplied into the pressure control chamber 71 through the inlet side orifice. However, the passage diameter of the outlet side orifice 72 is greater than that of the inlet side orifice. Therefore, the fuel pressure in the pressure control chamber 71 acting on the command piston 60 decreases. As a result, the balance among the fuel pressure in the pressure control chamber 71, the force pushing up the needle 31 in the valve opening direction and the force of the spring 69 pushing down the needle 31 in the valve closing direction is broken. When the force biasing the needle 31 in the valve opening direction exceeds the force biasing the needle 31 in the valve closing direction, the needle 31 lifts and opens the injection holes 41. Thus, the fuel is injected.

Thereafter, if the energization of the solenoid 83 is stopped, the armature 81 closes the outlet side orifice 72. Thus, the fuel pressure in the pressure control chamber 71 increases again. When the force biasing the needle 31 in the valve closing direction exceeds the force biasing the needle 31 in the valve opening direction, the needle 31 is pushed down to close the injection holes 41. Thus, the injection is ended.

Next, effects of the present embodiment will be explained. In the assembled state of the command piston 60 and the nozzle holder 50, the clearance 551 formed between the second sliding portion 62 of the command piston 60 and the second guide portion 52 of the nozzle holder 50, which can slide on each other, decreases toward the pressure control chamber 71, to which the pressure of the high-pressure fuel is applied, or the clearance $\epsilon h$ is smaller than the clearance $\epsilon l$. Thus, if the high-pressure fuel is supplied into the pressure control chamber 71 and the pressure in the pressure control chamber 71 increases when the fuel injection device 10 is actually in the injecting state, the inner periphery of the cylinder 52 as the guide portion on the pressure control chamber 71 side is enlarged by the deformation due to the high-pressure fuel. Thus, the clearance $\epsilon h$ on the fuel control chamber 71 side enlarges. Accordingly, the clearances $\epsilon h$, $\epsilon l$ can be set so that the clearance $\epsilon h$ on the pressure control chamber 71 side substantially coincides with the clearance $\epsilon l$ on the side opposite from the pressure control chamber 71 in accordance with the pressure of the high-pressure fuel in the used range. As a result, the clearance 551 between the second sliding portion 62 and the cylinder 52 as the second guide portion becomes substantially even in a state in which the pressure of the high-pressure fuel is at a predetermined high pressure. Thus, the second sliding portion 62 contacts the second guide portion 52 in a large area. Thus, the pressure acting on the contacting surfaces decreases and the abrasion can be inhibited. Thus, the increase in the fuel leak with time can be prevented.

The present embodiment can be suitably applied to the fuel injection device 10 structured so that a ratio of the minimum thickness T2 of the nozzle holder 50 at the guide portion 52 to the external diameter ΦD2 of the sliding portion 62 of the command piston 60 is equal to or greater than 1.0. Even if the ratio T2/ΦD2 is close to 1.0 as the lower limit, the abrasion between the sliding portion 62 and the guide portion 52 can be inhibited and the increase in the leak fuel with time can be prevented. The ratio T2/ΦD2 should be preferably set at 1.5 or over. As the ratio T2/ΦD2 is increased, the deformation of the nozzle holder 50 (the increase of the clearance 551) due to the high pressure can be reduced and the fuel leak can be reduced.

The present embodiment can be suitably applied to the fuel injection device 10 structured so that a ratio of the length L2 of the nozzle holder 50 at the guide portion 52 to the external diameter ΦD2 of the sliding portion 62 of the command piston 60 is equal to or greater than 2.5. Even if the ratio L2/ΦD2 is close to 2.5 as the lower limit, the abrasion between the sliding portion 62 and the guide portion 52 can be inhibited and the increase in the leak fuel with time can be prevented. The ratio L2/ΦD2 should be preferably set at 5.0 or over.

The structure of the third embodiment can exert the effects similar to the first embodiment.

MODIFICATIONS

In the first embodiment, in order to reduce the clearance 51 toward the fuel sump chamber 16 in the assembled state, the internal diameter of the inner periphery of the guide hole upper portion 12*a*, or the internal diameter of the inner periphery of the guide hole 12, is reduced toward the fuel sump chamber 16. Alternatively, the external diameter of the large diameter circular column portion 32 may be enlarged toward the pressure receiving portion, or the insertion portion 34, 35, 37.

In the third embodiment, in order to reduce the clearance 551 toward the pressure control chamber 71 in the assembled state, the internal diameter of the cylinder 52 is reduced toward the pressure control chamber 71. Alternatively, the external diameter of the second sliding portion 62 may be reduced toward the pressure control chamber 71.

In the second embodiment, the sleeve 18 is formed separately from the nozzle body 11 and is integrated with the nozzle body 11 by the press-fitting process and the like. Alternatively, the sleeve 18 and the nozzle body 11 may be formed in a single piece.

In the second embodiment, the sleeve 18 may be made of a material having higher abrasion resistance than the nozzle body 11. Thus, the abrasion resistance can be improved with respect to the same pressure acting on the contacting surfaces Thus, the abrasion can be inhibited even if the second fuel sump chamber 19 extends to a certain degree that the fuel sump chamber side clearance Φh slightly enlarges in accordance with the pressure of the high-pressure fuel.

The sleeve 18 may be provided by a bearing member, of which material is different from the material of the nozzle body 11. Thus, the abrasion resistance can be improved with respect to the same pressure acting on the contacting surfaces.

Figure 5:
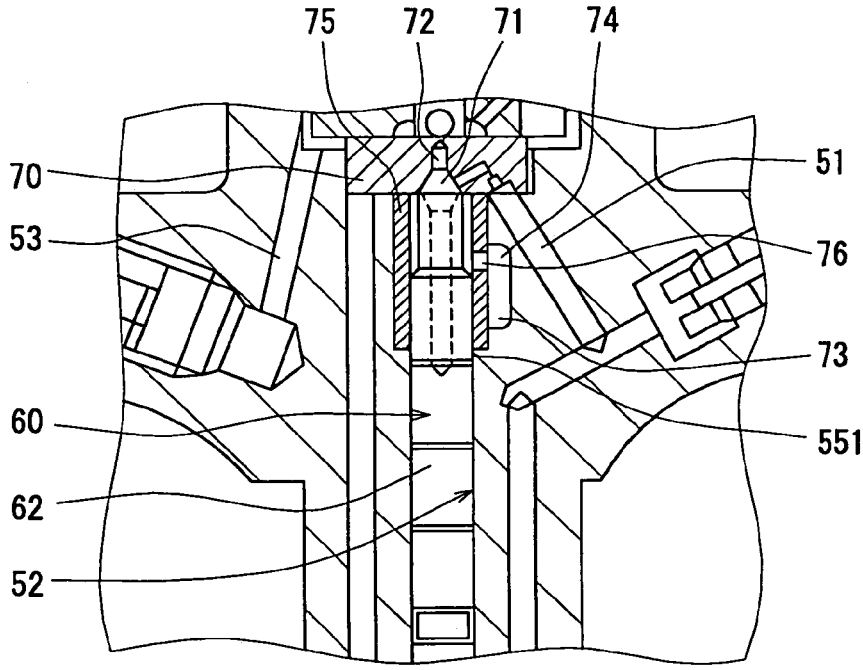
FIG. 5 is an enlarged view showing a substantial part of a fuel injection device of a modified example of the third embodiment.
Figure 6:
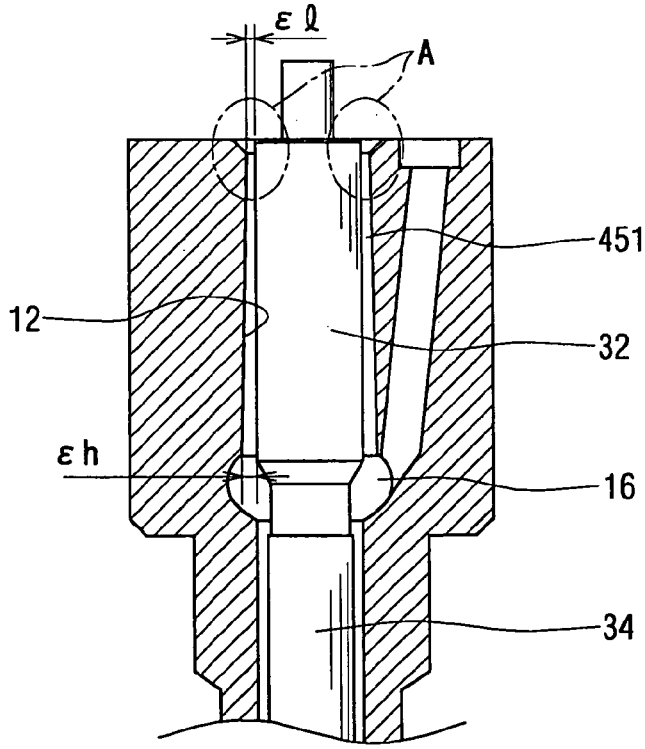
FIG. 6 RELATED ART
FIG. 6 is a partial sectional view showing a neighborhood of a sliding portion and a guide portion of a fuel injection device of a related art.

In the third embodiment, the clearance 551 decreases toward the pressure control chamber 71 in the assembled state. Alternatively, a second fuel sump chamber of the second embodiment, which extends to the inside of the guide portion along the axial direction and communicates with the fuel sump chamber, may be employed. More specifically, a second fuel sump chamber, which extends to an inside of the cylinder 52 along the axial direction and communicates with the pressure control chamber 71, may be provided. More specifically, the pressure control chamber 71 may be formed with a third fuel sump chamber 73 extending to the inside of the cylinder 52 along the axial direction as shown in FIG. 5. Alternatively, the cylinder 52 may be formed with a fourth fuel sump chamber 74 extending to the pressure control chamber 71 side along the axial direction as shown in FIG. 5. In the case where the third or fourth fuel sump chamber 73, 74 is formed, an inner peripheral portion of the second guide portion 52 radially inside the third or fourth fuel sump chamber 73, 74 may be provided by a sleeve 75 fitted into the second guide portion 52. In this case, the third or fourth fuel sump chamber 73, 74 may communicate with the pressure control chamber 71 through a communication hole 76 formed in the sleeve 75.

The present invention should not be limited to the disclosed embodiments, but may be implemented in many other ways without departing from the spirit of the invention.

What is claimed is:

1. A fuel injection device comprising:

a nozzle body formed with an injection hole for injecting fuel; and a nozzle needle reciprocating in the nozzle body along an axial direction to open and to close the injection hole, wherein the nozzle needle includes a sliding portion capable of moving in the nozzle body in a sliding manner, an insertion portion, of which diameter is smaller than that of the sliding portion, and a pressure receiving portion connecting the sliding portion with the insertion portion, the nozzle body includes a guide portion for slidably holding the sliding portion and a fuel sump chamber formed on the injection hole side of the guide portion so that the insertion portion is inserted through the fuel sump chamber, and the fuel sump chamber is formed with a second fuel sump chamber extending to an inside of the guide portion along the axial direction, wherein the second fuel sump chamber provides a substantially annular space radially outside the sliding portion.

2. A fuel injection device comprising:

a nozzle body formed with an injection hole for injecting fuel; and a nozzle needle reciprocating in the nozzle body along an axial direction to open and to close the injection hole, wherein the nozzle needle includes a sliding portion capable of moving in the nozzle body in a sliding manner, an insertion portion, of which diameter is smaller than that of the sliding portion, and a pressure receiving portion connecting the sliding portion with the insertion portion, the nozzle body includes a guide portion for slidably holding the sliding portion and a fuel sump chamber formed on the injection hole side of the guide portion so that the insertion portion is inserted through the fuel sump chamber, and the fuel sump chamber is formed with a second fuel sump chamber extending to an inside of the guide portion along the axial direction, wherein the second fuel sump chamber is formed along the entire inner circumference of the guide portion.

3. A fuel injection device comprising:

a nozzle body formed with an injection hole for injecting fuel; and a nozzle needle reciprocating in the nozzle body along an axial direction to open and to close the injection hole, wherein the nozzle needle includes a sliding portion capable of moving in the nozzle body in a sliding manner, an insertion portion, of which diameter is smaller than that of the sliding portion, and a pressure receiving portion connecting the sliding portion with the insertion portion, the nozzle body includes a guide portion for slidably holding the sliding portion and a fuel sump chamber formed on the injection hole side of the guide portion so that the insertion portion is inserted through the fuel sump chamber, and the fuel sump chamber is formed with a second fuel sump chamber extending to an inside of the guide portion along the axial direction, wherein the fuel injection device is formed so that an inner peripheral portion of the guide portion radially inside the second fuel sump chamber is provided by a sleeve, which is fixed to the guide portion.

4. The fuel injection device as in claim 3, wherein the sleeve is made of a material having higher abrasion resistance than the nozzle body.

5. The fuel injection device as in claim 3, wherein the sleeve is provided by a bearing member, of which material is different from that of the nozzle body.

* * * * *